United States Patent [19]

Baumann

[11] Patent Number: 4,584,840

[45] Date of Patent: Apr. 29, 1986

[54] COOLING MACHINE OR HEAT PUMP

[75] Inventor: Heinz Baumann, Winterthur, Switzerland

[73] Assignee: Sulzer Brothers Limited, Winterthur, Switzerland

[21] Appl. No.: 618,230

[22] Filed: Jun. 7, 1984

[30] Foreign Application Priority Data

Jun. 20, 1983 [CH] Switzerland ..... 3355/83

[51] Int. Cl.[4] ..... F25B 9/00; F01B 29/10

[52] U.S. Cl. ..... 62/6; 60/517; 60/721; 62/467

[58] Field of Search ..... 62/6, 118, 467; 60/517, 60/721

[56] References Cited

U.S. PATENT DOCUMENTS 3,006,154 10/1961 Brandon ..... 62/118 X
4,114,380 9/1978 Ceperley ..... 60/721
4,355,517 10/1982 Ceperley ..... 60/721

FOREIGN PATENT DOCUMENTS 2105022 7/1982 United Kingdom .

OTHER PUBLICATIONS

The Journal of the Acoustical Society of America, Nov. 1979, pp. 1508–1513.
Transition to Turbulence in Oscillating Pipe Flow Merkli & Thomann, J. Fluid Mech. (1975) vol. 68, Part 3, pp. 567–575.

*Primary Examiner*—William E. Wayner
*Attorney, Agent, or Firm*—Kenyon & Kenyon

[57] ABSTRACT

The cooling machine or heat pump has a thermoacoustic work system having a heat source and a heat sink coupled with at least one thermoacoustic drive system of like construction. The heat source of the drive system has a higher temperature than the heat source of the work system. The machine can be used in a refrigerating system with heat energy removed from a cold chamber and used as a heat source in the thermoacoustic work system. The machine can also be used in a heat pump heating system with heat energy removed by way of a first heat exchange surface from a burner and used as a heat source in the thermoacoustic drive system. A process water circuit is used as a heat sink for the thermoacoustic drive system while a heating-water circuit is used as a heat sink for the thermoacoustic work system.

14 Claims, 6 Drawing Figures

COOLING MACHINE OR HEAT PUMP

The invention relates to a cooling machine or heat pump having a thermoacoustic work system with a heat source and a heat sink.

A paper by Peter Merkli entitled "Theoretische und experimentelle thermoakustische Untersuchungen am kolbengetriebenen Resonanzrohr", Eidgenössische technische Hochschule, Zurich, 1973, pp. 43–45 and 73, describes a thermoacoustic system for use in a cooling machine or heat pump. As described, a resonance tube serves as a thermoacoustic work system wherein air is caused to oscillate at the bottom end of the tube by means of a piston, the top end of the tube being closed by an adjustable plug or the like which also comprises a pressure sensor. As in the case of the heat pump, the efficiency of a system of this kind may be defined as the quotient of cooling capacity and the mechanical energy expended by the piston.

This system, however, suffers from the disadvantage that a relatively complex drive system is needed to drive the piston if the piston is to perform a so-called sinusoidal movement. If the movement is other than sinusoidal, upper harmonics as well as the fundamental oscillation are produced in the resonance tube. The upper harmonics are a particular nuisance when they are near the resonances. Another disadvantage arises in connection with lubrication and cooling of the sinusoidal transmission and piston. As described, the cooling and lubrication of the system is based on blowing compressed air mixed with an oil mist. However, this is relatively complex. Further, the operating reliability of such a technique is unsatisfactory.

Accordingly, it is an object of the invention to provide a heat pump or cooling machine of thermoacoustic type which uses a relatively simple and operationally reliable drive.

It is another object of the invention to provide a cooling machine which employs a minimum of moving parts to effect a heat transfer.

It is another object of the invention to provide a cooling machine of thermoacoustic type of relatively compact and efficient structure.

Briefly, the invention provides a machine which can be used for cooling or for heat pump purposes. The machine comprises a thermoacoustic work system having a first heat exchanger for obtaining heat energy from a first heat source and a second heat exchanger for transferring heat energy to a heat sink. In addition, the machine has at least one thermoacoustic drive system coupled to the work system. This drive system has a third heat exchanger for obtaining heat energy from a second heat source which is at a higher temperature than the first heat source and a fourth heat exchanger for transferring heat energy to a heat sink.

The thermoacoustic oscillation in one system can then be used as a drive for the thermoacoustic oscillation in the other system, so that an intermediate mechanical drive can be omitted. Since thermal energy can be used directly to produce the thermoacoustic oscillations in the work system, overall efficiency is improved and the complete system can be much simpler and more compact than previously. Also, the omission of mechanical drive elements and the associated wear and lubrication problems greatly increases reliability of operation.

Since heat sources of relatively low temperatures can be used in the drive system, the range of use of the heat pump or cooling machine is widened.

Very advantageously, one or both of the drive and work systems may use at least one hollow member closed at both ends. Various thermoacoustic work media and hollow articles of various sizes can therefore be used.

The drive system and work system can also be received in a common tubular hollow member. This feature provides the advantage of a direct transmission of the thermoacoustic oscillation from the drive system to the work system.

Also, the drive system and work system can be separated from one another by a piston such as a double piston. This feature provides the advantage that the drive system and work system can have different piston diameters.

The drive system and work system can also be embodied by the arms of a U-tube. This feature leads to a very compact physical arrangement of the systems. Further, the U-tube arms can be separated from one another by a liquid. This feature makes separation of the systems very simple so that, for instance, different work media can be used.

At least one of the thermoacoustic systems can be formed with a space subdivided by partitions into parallel ducts. This feature provides a further improvement in efficiency. Also, the partitions can be heating walls or cooling walls. This feature leads to very effective heating or cooling of the discrete ducts.

The cooling machine or heat pump can be used in a refrigerating system wherein heat energy is derived from a cold chamber by way of a heat exchange surface and used as heat source in the thermoacoustic work system. In this case, a usable cooling effect is provided in the work system even when the temperature of the heat source in the drive system is relatively low. Consequently, for instance, waste heat which could otherwise be unusable can be exploited economically.

Finally, the cooling machine or heat pump can be used in a heating system wherein a burner is used as heat source in the thermoacoustic drive system; ambient heat is used as a heat source in the thermoacoustic work system; and a process water circuit is used as a heat sink for the thermoacoustic drive system to produce process water while a water-heating circuit is used as a heat sink for the thermoacoustic work system to produce heating water for the radiator system. This feature provides the advantage of a very simple and low-cost production of utilization water.

This invention will become more apparent from the following detailed description taken in conjunction with the accompanying drawings wherein.

Figure 5:
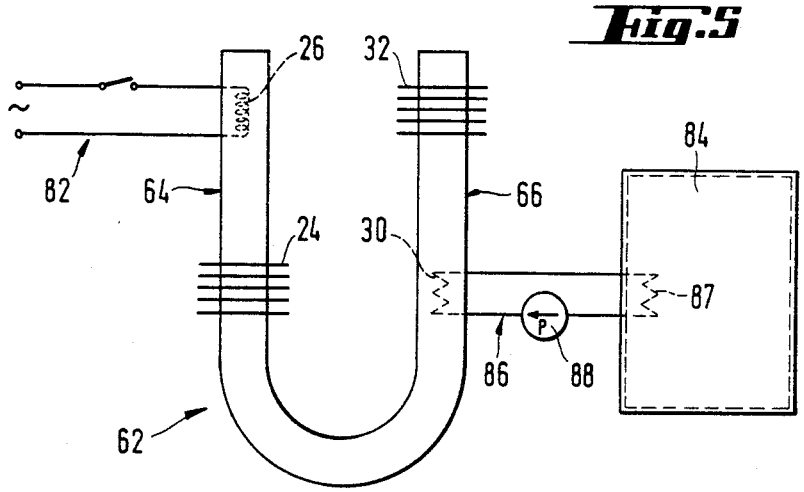
Figure 6:
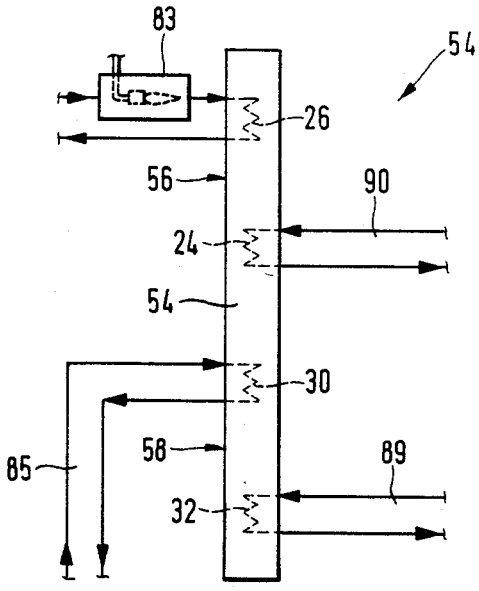

FIG. 5 schematically illustrates a refrigerating system in accordance with the invention; and FIG. 6 schematically illustrates a heating system in accordance with the invention.

Figure 1:
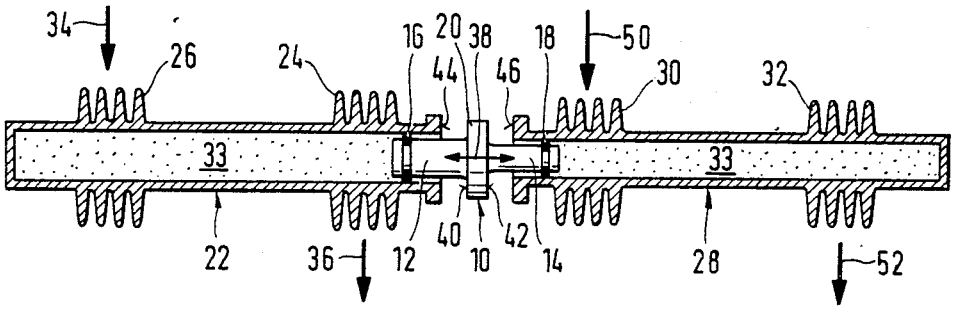
FIG. 1 illustrates a part cross-sectional view of a cooling machine constructed in accordance with the invention.

Referring to FIG. 1, the machine which may be used a cooling machine or heat pump has a pair of tubes 22, 28 which are coupled together by means of a double piston 10.

The double piston 10 includes two component pistons 12, 14 each of which carries a piston ring 16, 18. In addition, the piston 12 has a central part 20 which connects the pistons 12, 14 and which permits the piston 12 to be of larger diameter than the piston 14.

As shown, one piston 12 moves in one tube 22 while the other piston 14 is guided in the tube 28. Each tube 22, 28 is closed at the end and each has a pair of heat exchangers in the form of exchange surfaces 24, 26; 30, 32. In addition, a gaseous medium 33, such as air, is present in the tubes 22, 28.

For the purpose of giving an example of how the cooling machine or heat pump described operates, it will be assumed that the tube 22 is devised as a thermoacoustic drive system, with one heat exchange surface 26 obtaining heat energy from hot air as a heat source flowing over the heat exchange surface 26 in the direction indicated by an arrow 34, while the other heat exchange surface 24 yields heat energy by transfer, in the direction indicated by an arrow 36, to a heat sink in the form either of the environment or of a heating system.

Thermoacoustic oscillations are excited in the tube 22 and cause the double piston 10 to oscillate in a direction indicated by a double arrow 38, the oscillations of the piston 10 being limited by abutment surfaces 40, 42 on the central part 20 and by abutment surfaces 44, 46 of the tubes 22, 28, respectively. The oscillations of the piston 14 in the tube 28 excite thermoacoustic oscillations therein. In the meanwhile, the heat exchange surface 30 receives heat, in the direction indicated by an arrow 50, from a second heat source in the form of a cold chamber or the environment while the heat exchange surface 32 yields heat, in the direction indicated by an arrow 52, to a heat sink in the form either of the environment or of a heating system. The temperature of the heat exchange surface 30 is lower than the temperature of the heat exchange surface 32. The temperature of the heat source in the direction indicated by the arrow 34 is higher than the temperature in the direction indicated by the arrow 50.

Figure 2:
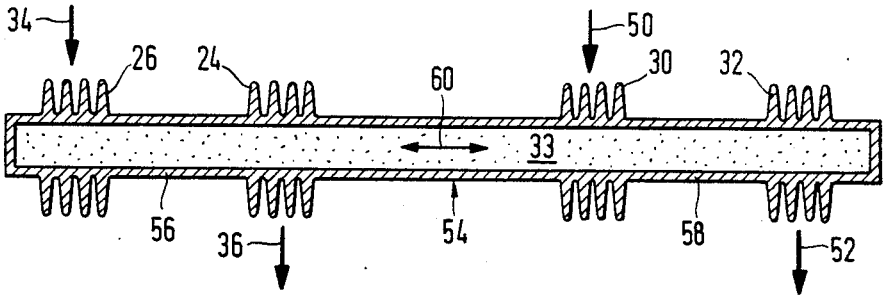
FIG. 2 illustrates a further embodiment of the invention.

Referring to FIG. 2, wherein like reference characters inidcate like parts as above the heat exchange surfaces 24, 26 and 30, 32 can alternatively be provided on a single tube 54 which is closed at both ends, with one tube part 56 serving as the thermoacoustic drive system and the other tube part 58 serving as the theromoacoustic work system.

Operation is basically as in the previous example except that the thermoacoustic oscillations induced in the tube part 56 are transmitted directly, in the direction indicated by a double arrow 60, to the tube part 58 by the gaseous medium 33.

Figure 3:
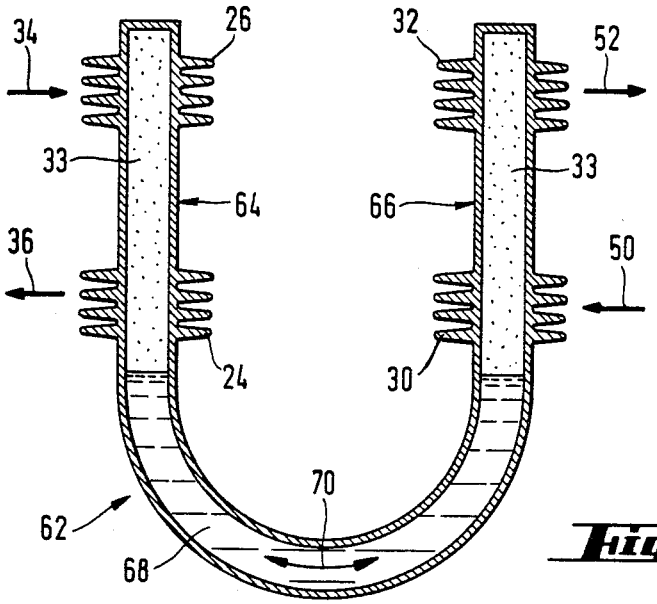
FIG. 3 illustrates a machine constructed in accordance with the invention in the form of a U-shaped tube.

Referring to FIG. 3, wherein like characters indicate like parts as above, the tube 54 is replaced by a U-shaped tube 62 having two arms 64, 66 each of which defines either the thermoacoustic drive or the work system. In addition, a liquid medium 68 is disposed in the bottom part of the U-tube to separate the work system from the drive system.

Operation is basically as for the embodiment shown in FIG. 1, except that in the embodiment of FIG. 3 the liquid medium 68 serves as a piston and oscillates as indicated by a double arrow 70.

Figure 4:
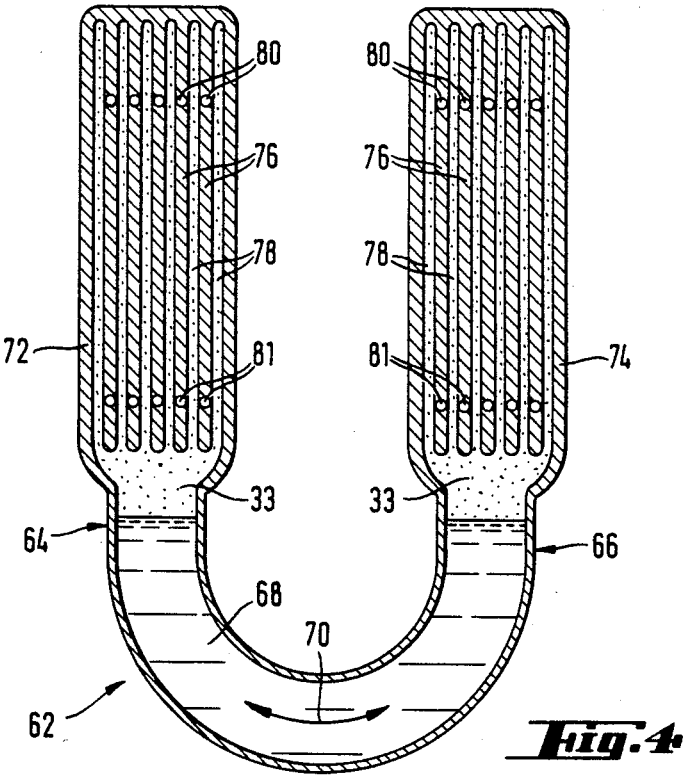
FIG. 4 illustrates a machine similar to FIG. 3 employing a plurality of partitions to form parallel flow ducts in accordance with the invention.

Referring to FIG. 4 wherein like reference characters indicate like parts as above, the arms 72, 74 of a U-shaped tube 62 are subdivided by partitions 76 into parallel flow ducts 78. Through the agency of bores 80, 81 serving as heating lines and cooling lines for a heat-transfer medium, the partitions 76 are embodied as heating walls and cooling walls respectively, the supply and removal of heat and the operation corresponding to the embodiment shown in FIG. 3. However, the parallel ducts 78 increase output since they correspond to a number of parallel-connected thermoacoustic oscillatory systems.

Referring to FIG. 5, wherein like reference characters indicate like parts as above, the machine may be used in a refrigerating system with a cold chamber 84. As indicated, an electric heating means 82 serves as a heat source for the thermoacoustic drive system 64 while the cold chamber 84 serves as the heat source in the thermoacoustic work system 66. In addition, the cold chamber 84 is connected to the work system 66 by way of a cooling circuit 86 having a heat exchange surface 87 within the cold chamber 84 and a pump 88.

When the system is in operation, the heat source 82 supplies a heating current of 100 watts at a temperature of 350° C., whereas from heat source 84*a* heat current of 75 watts at −10° C. is supplied, this therefore corresponding to the cooling capacity of the chamber 84. The heat exchange surfaces 24, 32 yield a heating current of 80 watts and 95 watts respectively, and at a temperature of 20° C., to the environment which, in this case, serves as the heat sink.

Referring to FIG. 6, wherein like reference characters indicate like parts as above, the machine may be used in a heating system. As shown, an oil or gas burner 83 serves as a heat source for the thermoacoustic drive system 56 while an ambient heat circuit 85 serves as the heat source for the termoacoustic work system 58. In addition, a process water circuit 90 serves as a heat sink for the drive system 56 while a water-heating circuit 89 serves as a heat sink for the work system 58.

When the heating system is in operation, the heat exchange surface 26 obtains heat energy from the burner 83 at a heating current rate of 10kW at a temperature of 450° C. while the environment, which serves as the second heat source, supplies heat energy to the heat exchange surface 30 at a heating current rate of 6kW at 0° C. The process water circuit 90 receives a heating current of 7.8kW at a temperature of 55° C. and the water heating circuit 89 receives a heating current of 8.2kW at 40° C.

In the various embodiments, the tubes 22, 28 and corresponding arms 64, 66 may contain various media.

The invention thus provides a cooling machine or heat pump which utilizes a thermoacoustic work system and a thermoacoustic drive system which are coupled together in a compact simple manner to achieve an efficient operation.

What is claimed is:

1. A cooling machine comprising a thermoacoustic work system having a first heat exchanger for obtaining heat energy from a first heat source and a second heat exchanger for transferring heat energy to a heat sink; and at least one thermoacoustic drive system coupled to said work system, said drive system having a third heat exchanger for obtaining heat energy from a second heat source at a higher temperature than said first heat source and a fourth heat exchanger for transferring heat energy to a heat sink.

2. A cooling machine as set forth in claim 1 wherein at least one of said work system and said drive system has at least one hollow member with a pair of closed ends.

3. A cooling machine as set forth in claim 2 wherein said hollow member is common to said work system and said drive system.

4. A cooling machine as set forth in claim 2 which further comprises a double piston between said work system and said drive system.

5. A cooling machine as set forth in claim 2 wherein a U-shaped tube has one arm defining said work system and a second arm defining said drive system.

6. A cooling machine as set forth in claim 5 which further comprises a liquid in said tube separating said work system from said drive system.

7. A cooling machine as set forth in claim 1 wherein at least one of said work system and said drive system has a plurality of partitions defining a plurality of parallel flow ducts for said heat exchangers therein.

8. A cooling machine as set forth in claim 7 which further comprises a plurality of lines in said partitions for directing a heat transfer media therethrough.

9. A cooling machine as set forth in claim 1 wherein said work system includes a first tube with said first and second heat exchangers disposed about said tube in spaced relation to each other, and said drive system includes a second tube with said third and fourth heat exchangers disposed about said second tube in spaced relation.

10. A cooling machine as set forth in claim 9 which further comprises a double piston slidably mounted at each end in a respective tube.

11. A cooling medium as set forth in claim 1 wherein each of said systems includes a tube and one heat exchanger therein includes a plurality of partitions defining parallel flow ducts in said tube and lines in said partitions to direct a heat transfer medium therethrough.

12. A cooling system as set forth in claim 11 wherein each of said systems includes lines in said partitions to direct a second heat transfer medium therethrough to define the other heat exchanger therein.

13. A refrigerating system comprising a cold chamber; and a cooling machine for cooling said cold chamber; said machine including a theromacoustic work system having a first heat exchanger for obtaining heat energy from said cold chamber and a second heat exchanger for transferring heat energy to a heat sink, and a theromacoustic drive system coupled to said work system, said drive system having a third heat exchanger for obtaining heat energy from a heat source at a higher temperature than said cold chamber and a fourth heat exchanger for transferring heat energy to a heat sink.

14. A heating system comprising a burner for generating a first heat source;

a process water circuit;

a water heating circuit; and a heat pump having a thermoacoustic drive system including a first heat exchanger for obtaining heat energy from said burner and a second heat exchanger for transferring heat to said process water circuit and a thermoacoustic work system including a third heat exchanger for obtaining ambient heat energy and a fourth heat exchanger for transferring heat to said water heating circuit.

* * * * *

UNITED STATES PATENT AND TRADEMARK OFFICE

CERTIFICATE OF CORRECTION

PATENT NO. : 4,584,840

DATED : April 29, 1986

INVENTOR(S) : HEINZ BAUMANN

It is certified that error appears in the above-identified patent and that said Letters Patent is hereby corrected as shown below:

Column 3, line 3 change "used" to -used as-

Column 3, line 49 change "inidcate" to -indicate-

Column 3, line 49 change "above the" to -above, the-

Column 3, line 53 change "theromoacoostic" to -thermoacoustic-

Column 4, line 39 change "termoacoustic" to -thermoacoustic-

Column 6, line 1 change "medium" to -machine-

Signed and Sealed this

Seventh Day of October, 1986

[SEAL]

*Attest:*

DONALD J. QUIGG

*Attesting Officer*

*Commissioner of Patents and Trademarks*